United States Patent [19]

Sanchez

[11] 4,396,380

[45] Aug. 2, 1983

[54] PROCESS FOR THE PREFLANGING OF THE MOUTHS OF CARDBOARD OF COMPOSITE CONTAINERS FOR THEIR SUBSEQUENT SEALING

[75] Inventor: Francisco G. Sanchez, Malaga, Spain

[73] Assignee: Metalgrafica Malaguena, S.A., Malaga, Spain

[21] Appl. No.: 198,857

[22] Filed: Oct. 20, 1980

[30] Foreign Application Priority Data

Nov. 20, 1979 [ES] Spain ..... 486.181

[51] Int. Cl.[3] ..... B31C 11/02

[52] U.S. Cl. ..... 493/290; 493/158; 493/293; 493/354

[58] Field of Search ..... 493/271, 290, 288, 287, 493/291, 293, 159, 158, 160, 354

[56] References Cited

U.S. PATENT DOCUMENTS

| | | | |
|---|---|---|---|
| 710,386 | 9/1902 | White et al. | 493/271 |
| 1,826,077 | 10/1931 | Johnson | 493/271 X |
| 2,441,014 | 5/1948 | Faucherre | 493/159 X |
| 2,608,140 | 8/1952 | Finlay et al. | 493/293 X |
| 3,547,011 | 12/1970 | Farquhar | 493/158 X |
| 3,668,981 | 6/1972 | Turpin et al. | 493/158 X |

*Primary Examiner*—James F. Coan

*Attorney, Agent, or Firm*—Dennison, Meserole, Pollack & Scheiner

[57] ABSTRACT

A method of simultaneously flanging and cutting tubular bodies by scoring the tubular bodies on each side of the cut is disclosed.

3 Claims, 2 Drawing Figures

PROCESS FOR THE PREFLANGING OF THE MOUTHS OF CARDBOARD OF COMPOSITE CONTAINERS FOR THEIR SUBSEQUENT SEALING

The invention refers to a procedure by which the operation of flanging mouths of containers to receive seals by folding is shortened and simplified.

The invention relates to a method based on the incorporation of a combined tool for the purpose of flanging of containers, specifically, at the same time that the perimeter is cut in order to give it the foreseen height.

This type of flange is an indispensable element in vessels formed or made up of a cardboard body or composite cardboard bodies for fastening the lids, generally metallic, by the system called peripheral folding.

The invention specifically refers to cylindrical or tube-shaped containers with a compound edge that, on the edges of the respective mouths, there is a bent flange or one that is turned outward in such a way that the metallic lid may be peripherally folded over the aforementioned flange.

In the prior art procedures, cylindrical tube-shaped containers are shaped starting with a continuous band of composite cardboard. This may be formed by winding the material in a spiral, with sealing of the respective edges in contact by means of binding or welding or the like.

The procedure in question shapes a continuous cylindrical tube-shaped body around a mandrel on which the cutting tools are applied, to produce one or more cylindric tube-shaped bodies with symmetrical heights and measurements.

The cylindrical bodies thus formed according to the prior art procedure, are subjected to some flanging machines like presses that exert on their respective mouths pressures or bellmouths by means of conic dies that force the slightly malleable structure from the compound cardboard body from said containers.

Also, according to the previous procedure, these operations are separated from one another although in order to synchronize them, conveyors, tools and other various devices that do not affect the concept of the present invention, can be used.

One of the essential characteristics of the invention is that in the cutting operation is done simultaneously with the operation of flanging the mouths of the cut body.

Another one of the characteristics of the invention is that the flanging appliances are incorporated into the cutting tool itself.

Another detail is that said appliances are located on both sides of the cutting tool with a previously calculated margin for producing, over the mouth, and below the cutting line, a line or slot over the body of the container.

Another detail is that this strip is made without cutting or weakening the center of the band that gives rise to the tube-shaped body.

Another detail is that said strip is produced at a previously calculated height in order to determine the bending or turning line that gives rise to the definitive height of the flange to be made.

Another detail is that said line or slot is produced according to an inclination or an inwardly oriented angular bevel according to the attack projection of the tool, made so that the produced flange bends or turns outward upon subjecting the body to the pressure of the mandrel of the folding machine in order to obtain the necessary deviation of the flange to the subsequent folding effects.

Another detail of the invention is that the strip or slot tool consists of tools coupled on both sides of the cutting blade, with points shaped according to the inclination angle desired for the incision to be made.

One of the advantages of the procedure is that the cutting and stripping operation is done simultaneously.

Another one of the advantages of the method is that one can dispose of one or more sets of tools in order to carry out simultaneous operations.

Another significant advantage of the invention is that the resulting container is finished for its direct sealing operation.

I will subsequently provide a more extensive description of the characteristics of the invention with reference to the drawings that are included in this specification in which in a schematic and, only as an example, the preferred details of the invention are represented.

IN THE DRAWINGS

Figure 1:
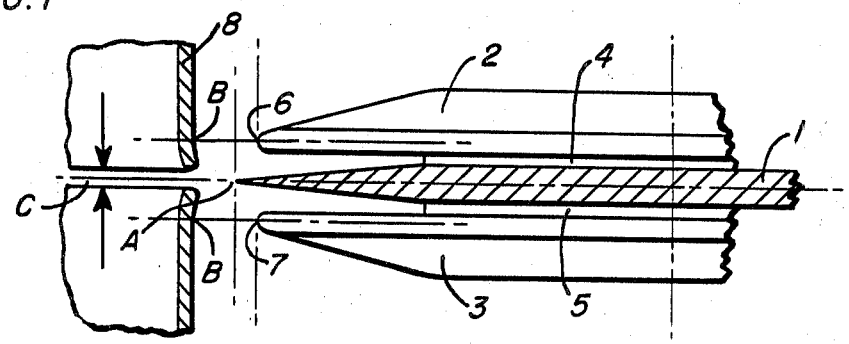
FIG. 1 is an enlarged sectional view of an example, endwise, of a combined tool which is the object of the invention.

Alluding to the numerical references of the drawings it will be noted that the combined tool is made up of a cutting tool 1 on which, on both sides, by means of coupling devices or spacers 4 and 5, the preflanging tools 2 and 3 are fastened.

It is also noted that the cutting blade 1 has an incidence point A under the level of the points 6 and 7 of the lining or slotting tools in order to produce the preflanging.

The cutting blade 1 makes during its revolution the cut C of the tube-shaped body T forming the bodies of vessels 8. Of course, the cut made affects the center made up of the body of the container.

Points 6 and 7 of the stripping tools produce the line or slot B on both sides of the cutting line C.

The lining or slotting effect is pointed out in the drawing itself and also the incidence angle in such a way that the dotted line shows the tendency of the edge to bend outwards in order to form the sought after flange, simultaneously with the cutting operation, as I have been able to demonstrate.

Figure 2:
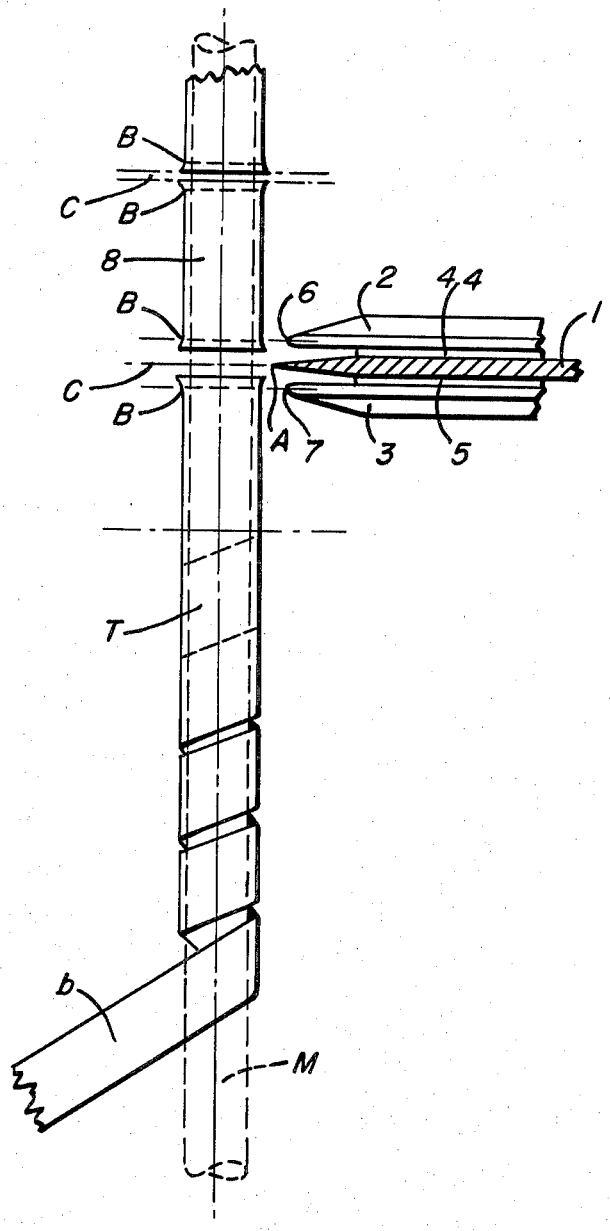
FIG. 2 is a schematic view with the same representation of the tool, according to the development of the process.

FIG. 2, shows a schematic development of the process shows us how the band b, that winds on the mandrel M, produces a tube T that will be severed in different cutting operations C with the simultaneous realization of the stripping or preflanging, resulting in containers 8 that have both mouths provided by this operation and ready to receive the lids, generally metallic, that are mounted by folding over the flanges B made on both ends or mouths of the container and in whose folding machine the mandrel itself exerts the necessary pressure for forcing the necessary arch of the flange for the purposes of the aforementioned folding.

I claim:

1. A process for the formation of flanges on the mouths of containers simultaneous with the cutting of a cylindrical length of a container from an indefinite length wound cylinder of paperboard mounted on a mandrel comprising the application of a cutting blade about the perimeter of the cylinder at a plane generally perpendicular to the longitudinal axis of the cylinder to sever the same, simultaneously with the cutting, applying pressure to the severed cylinder on either side of the cut and about the perimeter to form an outwardly directed flange on each of the severed ends.

2. A process as defined in claim 1 wherein the pressure is applied by means of a pair of tools mounted adjacent to and on either side of the cutting blade; the tools being set back from the blade so as not to penetrate said cylinder, but contacting the cylinder to provide a slight non-weakening slot.

3. A process as defined in either claim 1 or 2 wherein the tools are provided with a beveled edge.

* * * * *